US005217059A

United States Patent [19]

Kuhn et al.

[11] Patent Number: 5,217,059

[45] Date of Patent: Jun. 8, 1993

[54] CASTING CORE AND METHOD FOR FORMING A WATER JACKET CHAMBER WITHIN A CAST CYLINDER BLOCK

[75] Inventors: John W. Kuhn, Bristol; Richard J. Wylie, Wabash, both of Ind.

[73] Assignee: CMI International, Bristol, Ind.

[21] Appl. No.: 821,968

[22] Filed: Jan. 16, 1992

[51] Int. Cl.[5] ..... B22C 9/10

[52] U.S. Cl. ..... 164/132; 164/369; 164/370

[58] Field of Search ..... 164/132, 397, 369, 370, 164/132, 397

[56] References Cited

U.S. PATENT DOCUMENTS

| | | | |
|---|---|---|---|
| 818,413 | 4/1906 | Caldwell | 164/397 |
| 1,310,768 | 7/1919 | Nugent | 164/35 |
| 1,416,412 | 5/1922 | Pack | 164/14 |
| 1,864,456 | 6/1932 | Lüngen | 164/396 |
| 2,045,556 | 6/1936 | Almen | 22/165 |
| 2,173,955 | 9/1939 | Zahn | 22/212 |
| 2,304,879 | 12/1942 | Brazil | 22/190 |
| 2,362,875 | 11/1944 | Zahn | 22/200 |
| 2,688,781 | 9/1954 | Fahlberg et al. | 22/165 |
| 2,812,562 | 11/1957 | Dalton | 164/132 |
| 2,897,556 | 8/1959 | Chini | 164/132 |
| 2,907,084 | 10/1959 | Wood | 164/132 |
| 2,991,520 | 7/1961 | Dalton | 22/131 |
| 3,276,082 | 10/1966 | Thomas | 164/100 |
| 3,805,874 | 4/1974 | Wahlquist | 164/132 |
| 4,532,974 | 8/1985 | Mills | 164/132 |
| 4,917,169 | 4/1990 | Melde-Tuczai et al. | 164/369 |

*Primary Examiner*—Richard K. Seidel
*Assistant Examiner*—Erik R. Puknys
*Attorney, Agent, or Firm*—Reising, Ethington, Barnard, Perry & Milton

[57] ABSTRACT

A casting core (42) for forming a water jacket chamber (28) within a cylinder block (22) includes a bonded sand continuous wall portion (48) for forming a water passage (30) encircling a plurality of the cylinders (24) and through which water is circulated for cooling the perimeter of the cylinders (24). The casting core (42) also includes a bridging portion (46) that extends cross-wise in the wall (48) for forming a thin water passage bypass (32) extending through the thin web of cylinder block material (26) separating the adjacent cylinders (24) for providing cooling between the piston cylinders (24). The bridging portion (46) comprises a metal support element (64) covered by a sleeve of woven refractory material (66). A method is also provided for producing a cylinder block having such a casting core (42).

24 Claims, 4 Drawing Sheets

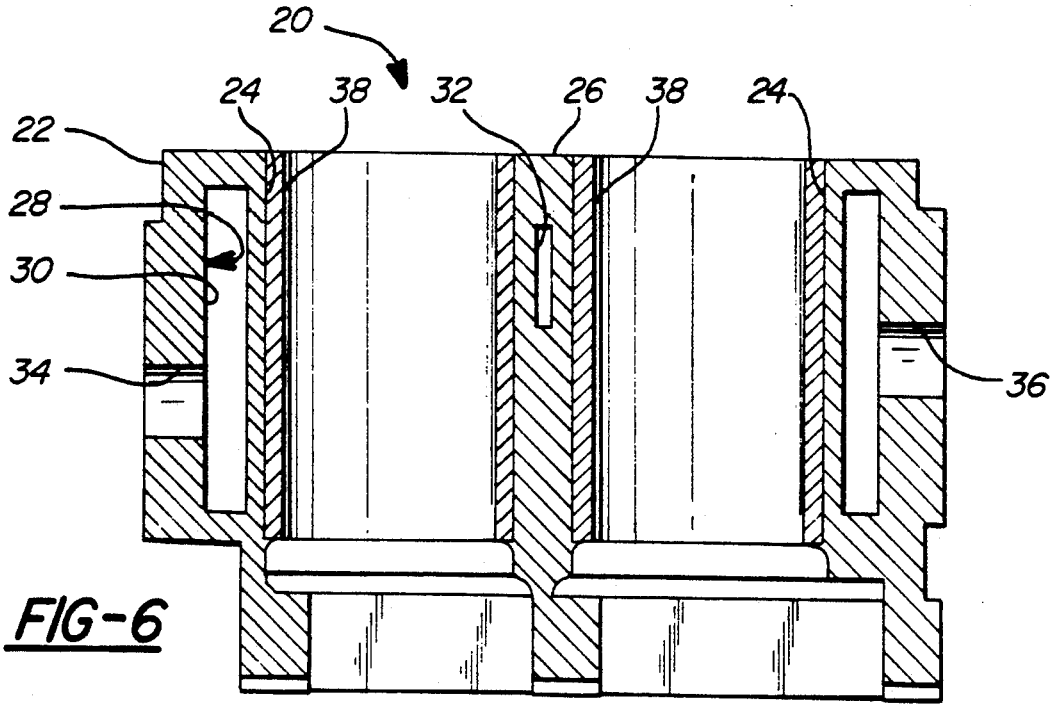
FIG-6
FIG-7
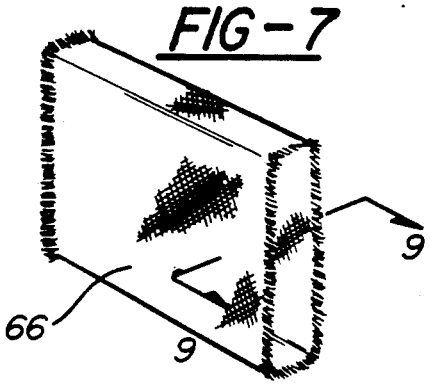
FIG-8
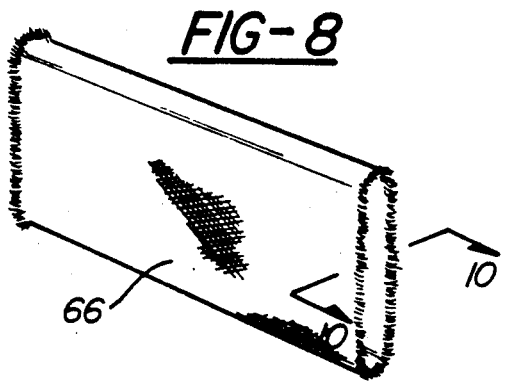
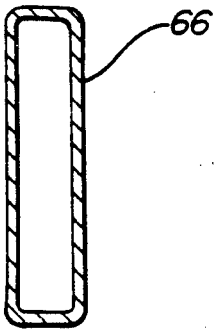
FIG-9
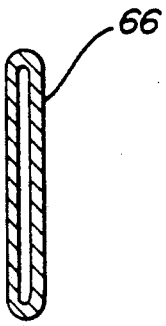
FIG-10
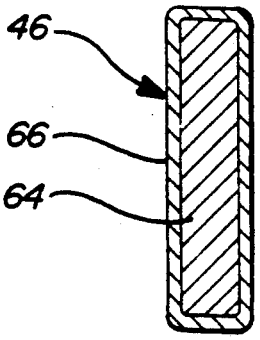
FIG-11

FIG-12
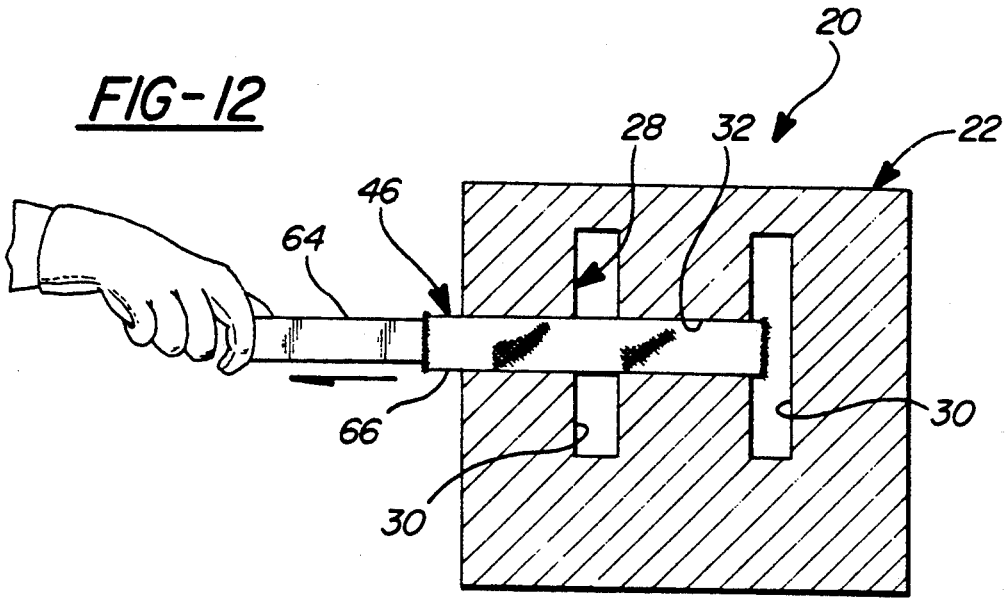
FIG-13
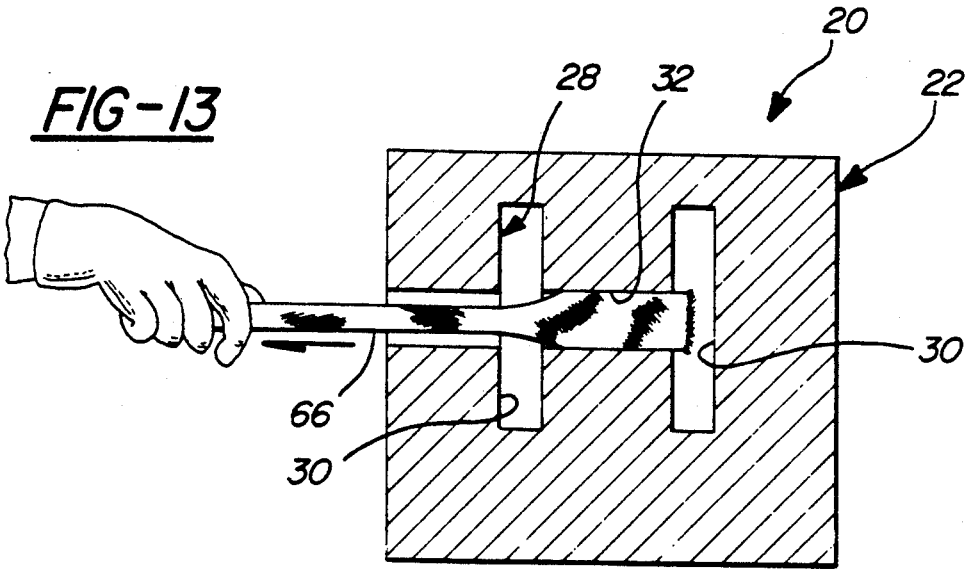
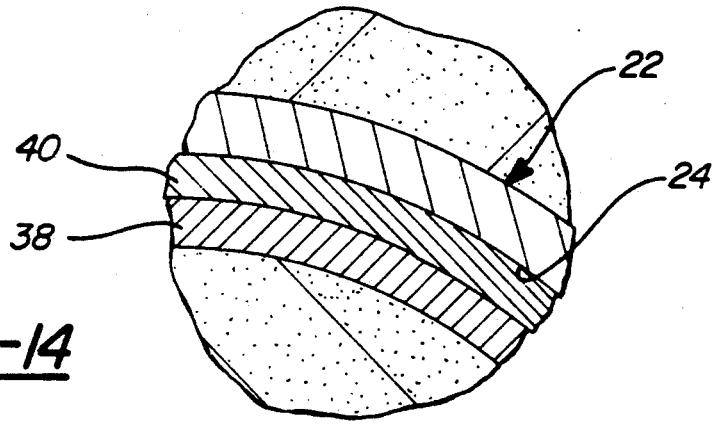
FIG-14

CASTING CORE AND METHOD FOR FORMING A WATER JACKET CHAMBER WITHIN A CAST CYLINDER BLOCK

BACKGROUND OF THE INVENTION

1. Field of the Invention

The present invention relates to casting cores and methods for forming a cored water jacket chamber within a cast cylinder block.

2. Description of the Prior Art

Most automobiles today are equipped with water-cooled engines having cast iron cylinder blocks. The cylinder block is formed with a number of piston cylinders in which pistons of the engine reciprocate. The reciprocating action of the pistons generates a tremendous amount of frictional heat which must be removed for the engine to continue working. Thus, it is common to provide a water jacket chamber within the cylinder block that completely surrounds each cylinder and in which coolant water is circulated for cooling the cylinder walls of the block during operation.

In order to make the engine more compact, the cylinders are spaced as closely together as practical. In practice, this means that the web of casting material separating adjacent cylinders is just wide enough to allow a conventional sand core to be used to form a water passage bypass through the webs cylinder block material to provide cooling between the cylinders. Any closer spacing would prohibit the use of such sand cores as they would be to fragile.

In an effort to reduce the weight and increase the efficiency and performance of these types of engines, automobile manufactures are turning toward lighter weight aluminum cylinder blocks as replacements for their heavier cast iron counter parts.

These aluminum cylinder blocks are typically provided with cylinder liners made of high wear resistant materials. These liners are secured within the cylinder block during casting or in a subsequent operation.

A problem arises, however, when one attempts to cast a water jacket into such a cylinder block having lined cylinders. Since the spacing of the cylinders has already been determined and fixed according to cast iron block standards, the web of aluminum cylinder block material is substantially diminished in size due to the addition of the cylinder liners. In fact, each web is reduced by an amount equal to twice the wall thickness of the cylinder liners. As mentioned previously, conventional sand coring techniques cannot be used to form the water bypass passages between adjacent cylinders having such a small web. As a result, it is common to employ a conventional sand core and simply eliminate the water bypassages in the block.

The U.S. Pat. No. 4,917,169, granted Apr. 17, 1990 to Melde-Tuczai et al. discloses a composite core for forming a water jacket chamber within a cylinder block having closely spaced cylinders. This patent teaches using a costly sintered ceramic material to form the water passage bypass which must be sand blasted out of the cylinder block following casting.

The U.S. Pat. No. 2,991,520 discloses a core in which a sleeve of refractory material is disposed about a support element for forming cored passages in metal castings. There is no teaching, however, of using such a core in combination of other core types such as conventional bonded sand cores to form a water jacket chamber within a cylinder block.

SUMMARY OF THE INVENTION AND ADVANTAGES

A casting core for forming water passages within a cylinder block having a plurality of adjacent cylinders separated from one another by webs of cylinder block material comprises a continuous ring-like wall of bonded particulate material for forming a water passage around the adjacent cylinders of the cylinder block, with the ring-like wall being void between the cylinders, and is characterized by at least one support element supported by the ring-like wall and covered with a sleeve of woven refractory material and bridging the void between the cylinders, wherein the ring-like wall portion of the core forms a water passage that encircles the plurality of adjacent cylinders through which water is circulated for cooling the perimeter of the adjacent cylinders and the sleeve-covered support element forms a water passage bypass extending through the web of cylinder block material separating adjacent cylinders and communicates with the encircling water passage for cooling between the adjacent cylinder of the cylinder block.

The subject invention also contemplates a method for casting a cylinder block having such a cored water jacket chamber. The method includes forming the elongated ring-like wall of bonded particulate material for forming the water passage around the perimiter of the adjacent cylinders; covering a support element with a sleeve of woven refractory material; supporting the sleeve-covered support element cross-wise within the continuous wall for forming the water passage bypass extending through the web separating the adjacent cylinders; disposing the wall and sleeve-covered support element core assembly within a cylinder block casting mold; casting molten cylinder block metal into the mold and around the core assembly to define the cylinders and the water passages and allowing the metal to solidify; removing the continuous wall portion of the core from within the cast cylinder block to create the encircling water passage and then removing the support element and sleeve to create the water passage bypass extending between the cylinders and through the web and communicating with the encircling water passage for cooling between the adjacent cylinders of the block.

One advantage of the subject invention is that a complete water jacket chamber can be formed within a cylinder block having closely spaced cylinders, including water bypasses extending through the webs of cylinder block material separating the adjacent cylinders.

Following casting, the core portions can be separated from one another by first shaking the bonded particulate wall portion out of the casting using conventional techniques and then removing the support element and sleeve from the cylinder block. In this way, both the bonded sand portion and sleeve-covered support element portion of the core can be kept separate from each other and reclaimed for subsequent reuse.

BRIEF DESCRIPTION OF THE DRAWINGS

Other advantages of the present invention will be readily appreciated as the same becomes better understood by reference to the following detailed description when considered in connection with the accompanying drawings wherein:

FIG. 6 is a cross-sectional view of the resultant cylinder block of FIG. 4;

FIG. 7 is a perspective view of the sleeve positioned in a shortened length enlarged perimeter condition;

FIG. 8 is a view like FIG. 7 but with the sleeve positioned in an increased length contracted perimeter condition;

FIG. 9 is a cross-sectional view taken along lines 9—9 of FIG. 7;

FIG. 10 is a cross-sectional view taken along lines 10—10 of FIG. 8;

FIG. 11 is a cross-sectional view of the sleeve-covered support element showing the sleeve being supported in the enlarged perimeter condition illustrated in FIG. 9;

FIG. 12 is another cross-sectional view of the block showing the support element being withdrawn from the block;

FIG. 13 is a view like FIG. 12 but showing the sleeve being removed from the cylinder block; and FIG. 14 is an enlarged fragmentary cross-sectional view of the encircled portion 14 of FIG. 5.

DETAILED DESCRIPTION OF THE DRAWINGS

Figure 1:
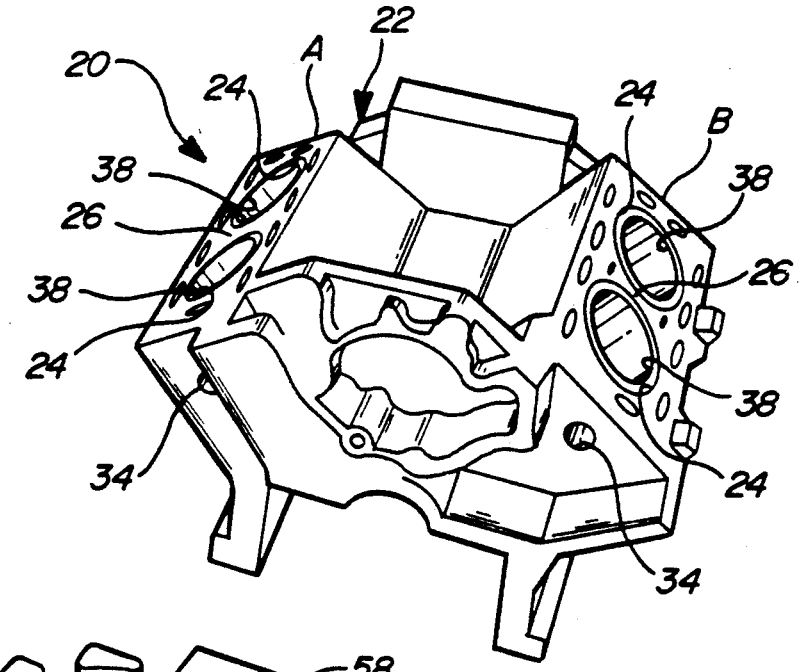
FIG. 1 is a schematic perspective view of a cylinder block formed in accordance with the present invention.

A cylinder block assembly constructed in accordance with the present invention is generally shown at 20 in FIG. 1. The cylinder block assembly 20 comprises a cylinder block 22 defining a plurality of adjacent piston cylinders generally indicated at 24 arranged in line and separated from one another by webs of cylinder block material 26. The cylinder block 22 depicted in FIG. 1 is a four cylinder V-type block. In this arrangement, there are two sets or banks of adjacent piston cylinders A and B arranged in line along the length of the cylinder block 22. The webs of cylinder block material 26 lie between every two adjacent cylinders 24 and serve to define and separate adjacent cylinders, as can best be seen in FIG. 6.

The cylinder block 22 is formed with a water jacket chamber generally indicated at 28 through which water is circulated for cooling the piston cylinders 24 of the block 22 during operation. The chamber 28 includes a first encircling water passage 30 that completely surrounds or encircles the plurality of piston cylinders 24, but is discontinuous between the adjacent piston cylinders 24. In other words, the encircling water passage 30 is interrupted by the webs 26 of the cylinder block 22.

The water jacket chamber 28 further includes water passage bypasses 32 that extend cross wise through each web 26 and communicating on each side with the encircling passage 30 for allowing water to circulate between the adjacent cylinders 24 as well. The cross-sectional size of the water bypasses 32 is much smaller than the size of the encircling water passage 30. Thus, the encircling water passage 30 allows water to be circulated for cooling the perimeter of the adjacent cylinders 24, whereas the bypasses 32 allow for passage of water and cooling between the cylinders 24.

The water jacket chamber 28 further includes an inlet opening 34 for admitting cooling water into the water jacket 28 and an outlet opening 36 for allowing the passage of cooling water out of the water jacket.

The cylinder block assembly 20 may also include cylinder liners 38 which are preformed as separate and distinct members from the cylinder block 22 but joined thereto for lining the cylinders 24. The cylinder liners 38 will typically be required when the cylinder block 22 is cast from a material such as aluminum. The liners 38 are constructed from a material that exhibits better wear properties than the aluminum cylinder block 22. Materials such as cast iron, steel and high silicon content aluminum alloys are to be suitable liner materials.

The liners 38 must be securely fastened within the cylinder block 22. This can be accomplished by either mechanically joining the liners 38 to the cylinder block 22, in known manner, or providing a metallurgical bond between the liners 38 and the cylinder block 22. With a metallurgical bond, a suitable, low melting point metal material, such as zinc, tin or cadmium is disposed between the liners 38 and alloyed or chemically mixed with each of the cylinder block and liner materials forming a metallurgical bond 40 between the liners 38 and the block 22. A fragmentary cross-sectional view of the metallurgical bond 40 is shown in FIG. 14. The inner most hatched region defines a portion of one of the cylinder liners 38, whereas the outer most hatched region defines a portion of the aluminum cylinder block 22. Separating the liner 38 and cylinder block 22 is a middle hatched region which represents a metallurgical bonded 40. With an aluminum block, iron cylinders and zinc bonding phase material, the metalurgically bonded region 40 comprises zinc alloyed with aluminum iron materials.

The cylinder block assembly 20 further comprises a casting core 42 for forming the water jacket chamber 28 within the cylinder block 22. The casting core 42 is comprised of essentially two portions, generally indicated at 44 and 46, respectively. The first portion 44 is formed of bonded particulate refractory material of the well known type, including such materials as bonded sand and the like. The bonded sand core portion 44 defines a continuous ring-like wall, which is essentially an elongated closed figure structure which defines the encircling water passage surrounding the plurality of cylinders 24. Described another way, the wall 48 comprises oppositely disposed longitudinal halves 50, 52 which extend along the opposing sides of the plurality of aligned cylinders 24 and are integrally joined at their respective ends so as to completely encircle the plurality of piston cylinders 24 and form the continuous, uninterrupted water passage 30 around the plurality of cylinders 24. Each of the longitudinal halves 50, 52 have a serpentine-like appearance which mirror one another to give the wall 48 the appearance of the plurality intersecting cylinders, with the spacing between the wall halves 50, 52 being narrowest between the adjacent cylinders 24 and increasingly wider at each cylinder 24.

The continuous wall 48 further includes water intake and exhaust cores 54, 56 formed intregraly with the wall 48 and extending outwardly in opposite directions from the opposite ends of the elongated wall 48. These intake and exhaust cores 54, 56 extend through the cylinder block 22 and are provided at their distal ends with core prints 58, 60 for being received in and supported by a cylinder block mold 62 in which the cylinder block 22 is cast.

The sleeve-covered portion 46 of the casting core 42 comprises a support element 64 supported cross-wise in the wall 48 and bridging the gap or void between the narrowest spacing of the oppositely disposed longitudinal wall halves 50, 52. The support element 64 comprises a thin rectangular metal plate durable enough to survive handling and the casting process without breaking.

The support element 64 is covered by a sleeve of woven refractory material, such as glass fibers which have been woven or braided into a tubular or sleeve-like configuration. A preferred sleeve material is sold under the registered trademark NATGLAS TM by Natvar Company, Highway 70 East, P.O. Box 658, Clayton, N.C. 27520. The weaving or braiding of the sleeve 66 permits it to be positioned between an enlarged perimeter condition, shown in FIGS. 7, 9, and 11 and contracted perimeter condition, shown in FIGS. 8 and 10. The change in perimeter size is accomplished by either compressing or elongating the sleeve along its length. In the case of the enlarged perimeter condition of FIG. 7, the sleeve 66 is compressed along its length and is relatively shorter than the sleeve 66 in the contracted perimeter condition of FIG. 8, in which the sleeve 66 has been elongated or stretched into a longer length. As also can be seen by comparing FIGS. 9 and 10, the sleeve 66 has a larger cross-sectional area when in the enlarged perimeter condition as compared to the area when in the contracted perimeter condition of FIG. 10.

The support element 64 is received in and supports the sleeve 66 in the expanded perimeter condition during casting as shown in FIG. 11.

Figure 2:
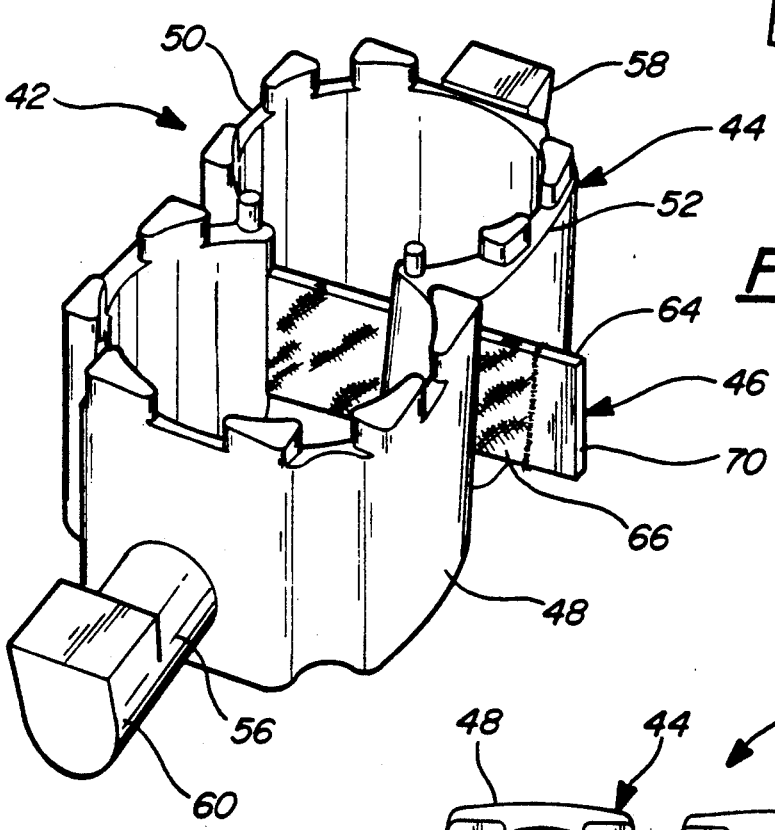
FIG. 2 is perspective view of a casting core constructed in accordance with the present invention.
Figure 3:
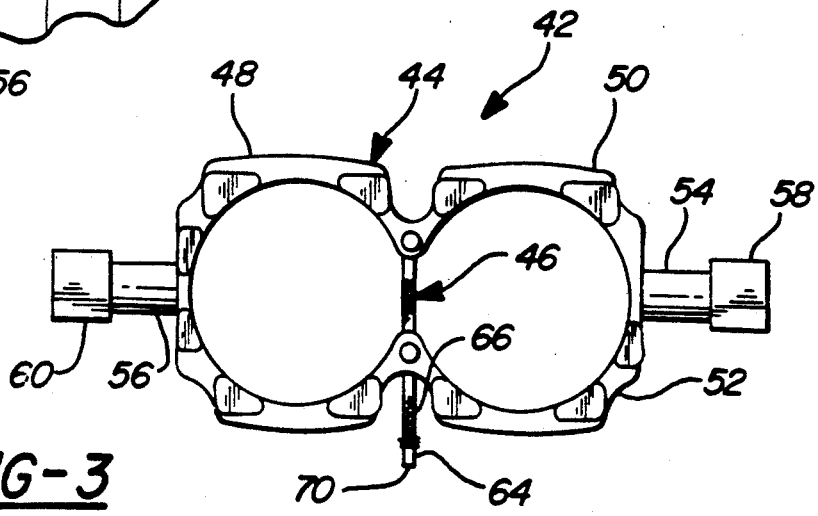
FIG. 3 is a top view of the core of FIG. 2.
Figure 5:
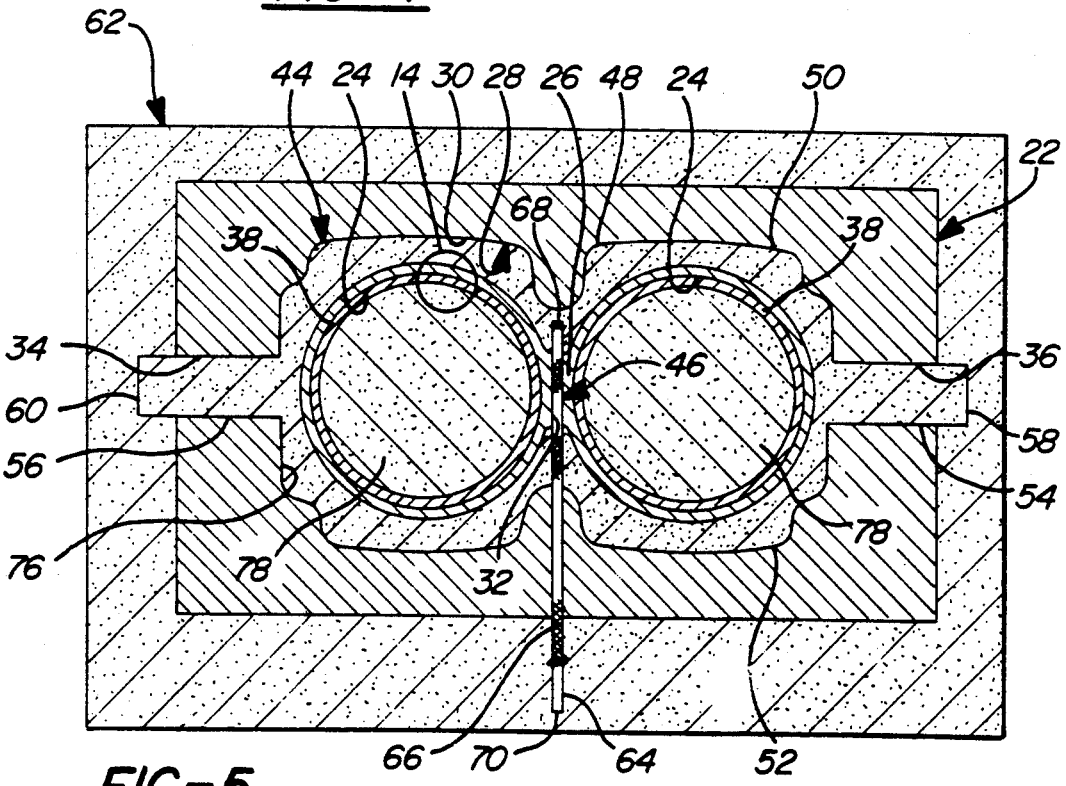
FIG. 5 is a cross-sectional view taken along lines 5—5 of FIG. 4.

As can be seen in FIGS. 2, 3, and 5, a first end 68 of the sleeve-covered support element 64 is supported by and terminates within one of the longitudinal halves 50 of the wall 48. From there the sleeve-covered support element 64 extends through the web 26, through and beyond the opposite longitudinal halve 52 of the wall 48 and through the cylinder block 22 to a distal end 70 spaced from the wall 48 and terminating in and supported by a wall of the cylinder block mold 62. This provides access to the sleeve-covered support element 64 for removal of the same following casting.

The cylinder block mold 62 is preferably of the sand mold type comprising cope 72 and drag 74 sections. The cope 72 and drag 74 define a casting cavity 76 having the shape of the cylinder block 22. The casting cavity 76 is formed by shaping the cope 72 and drag 4 sections against suitable pattern plates (not shown), as is well known to the art.

The casting core assembly 42 is formed by first obtaining a piece of refractory sleeve 66 and then compressing it along its length to position the sleeve 66 in the expanded perimeter condition as shown in FIGS. 7, 9, and 11. Thus, shortening the length of the sleeve 66 results in a corresponding enlargement of the perimeter of the sleeve 66. Once in this position, the outer surface of the sleeve should present a smooth, non-wrinkled surface. The support element 64 is then disposed within the enlarged perimeter sleeve 66 and supports the sleeve 66 in that condition, as shown in FIG. 11.

The sleeve-covered support element 64 is then formed in place with the sand core portion 44 of the core assembly 42. In other words, the sleeve-covered support element 64 is disposed within a core-forming cavity (not shown) within which the bonded sand wall portion 48 of the casting core 42 is formed. To form the wall, sand having a suitable binder is blown into the coring cavity and assumes the shape of the cavity. The bonded sand intake and exhaust cores 54, 56 as well as their associated core prints 58, 60 are formed integrally with the wall portion 48 during this process.

The core assembly 42 is then disposed within the casting cavity 76 of the mold 62, with the core prints 58, 60 supported by the cavity walls and the distal end 70 of the sleeve-covered support element 64 extending into and terminating within the cavity wall 76.

The cylinder liners 38 are then formed of a high wear-resistant material such as cast iron, steel or high silicon content aluminum alloys. The required number of liners, of course, will depend upon the number of cylinders 24 in the block 22.

The liners 38 are then joined to the cylinder block 22 with the metallurgical bond 40. It is preferred that the liners 38 be joined by casting the liners 38 in place with the cylinder block 22. With this process the liners 38 are first coated with the low melting point molten metal coating material, such as zinc, that is compatible with the aluminum cylinder block material and the chosen liner material so that it readily alloys with each of these materials during casting. The liners 38 are coated by preheating to about 1,200° F. and dipping them in a molten bath of the coating material, where the coating material is allowed to diffuse into an alloy with the outer surface of the cylinder liners 38. The liners 38 are withdrawn from the bath and the coating allowed to solidify. Any oxidation that has formed on the outer surface of the coating is then machined off to expose an unoxidized outer coating surface of the liners 38, and the liners 38 disposed within the casting cavity 76 of the mold 62 on barrel cores 78. The liners 38 in the mold are spaced from one another and the surrounding casting core 42 for exposing the outer coated surface of the cylinder liner 38 to the molten metal cylinder block material cast into the mold 62.

Figure 4:
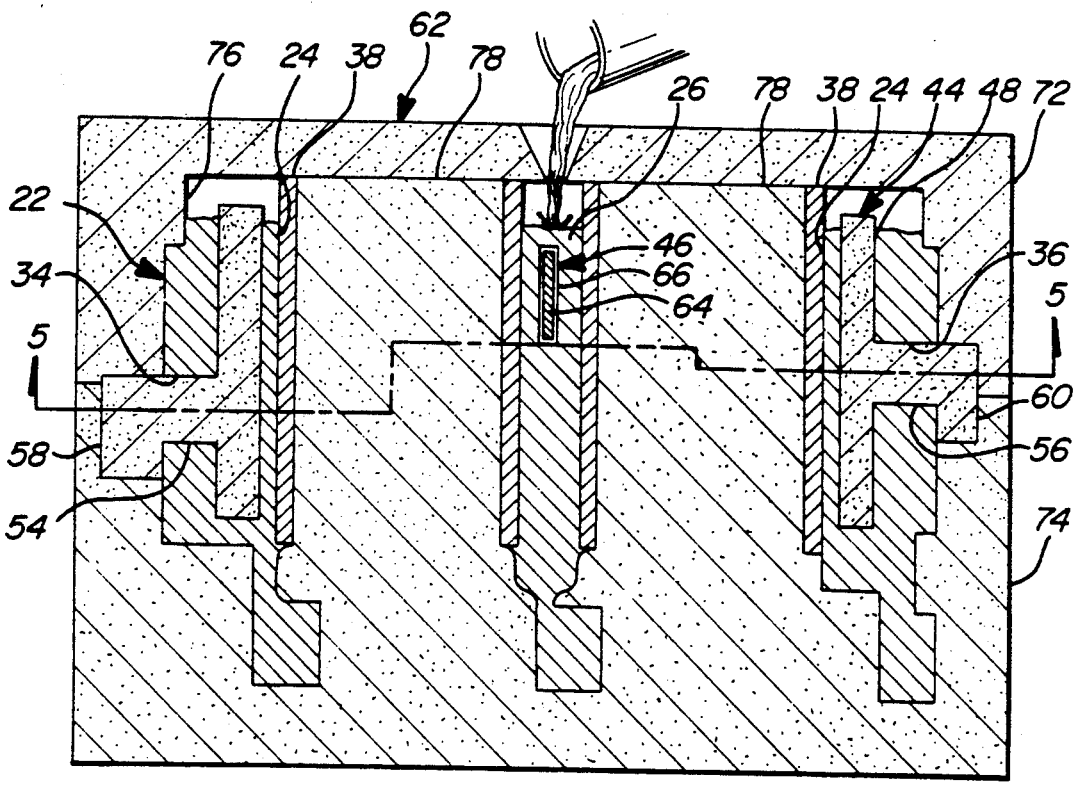
FIG. 4 is a cross-sectional view of a mold with the cylinder block being cast therein.

Once the casting core 42 and the cylinder liners 38 have been properly positioned within the mold 62, molten cylinder block metal is cast into the cavity 76 and around the casting core 42 and coated cylinder liners 38 as shown in FIG. 4.

As the molten cylinder block material contacts the outer coated surface of the cylinder liners 38, it causes the coating material on the liners 38 to remelt and further alloy with the aluminum block material. The metal in the mold is allowed to solidify, whereupon the cylinder liners 38 metallurgically bond to the aluminum cylinder block 22 as shown in FIG. 14.

The resultant cylinder block 22 is then removed from the mold 62 and the casting core 42 withdrawn from the block 22. In order to remove the sand core portion 44 of the casting core 42, the cylinder block 22 is heated to break down the bonding agent bonding the particulate material together. The cylinder block 22 is then shaken and the sand removed from the cylinder block 22 leaving behind the encircling water passage 30 within the block 22.

The support element 64 is then manually withdrawn from the cylinder block 22 (see FIG. 12), leaving the sleeve 66 in the expanded perimeter condition and attached to the cylinder block 22. The sleeve 66 is caused to adhere or stick to the cylinder block 22 because the molten cylinder block material slightly penetrates the interstices of the woven sleeve 66 during casting and then solidifies.

The sleeve 66 is then withdrawn from the cylinder block 22 by and pulling on the sleeve 66 in an outward direction along its length as depicted in FIG. 13. This causes the sleeve 66 to stretch and lengthen and forces the sleeve into the contracted perimeter condition. Thus, the weaving of a sleeve 66 directs the tension force applied along the length of the sleeve 66 radially inwardly causing the perimeter of the sleeve 66 to constrict and the outer surface of the sleeve 66 to pull free (i.e. detach) from the cylinder block 22 for easy removal, as also shown in FIG. 13.

Although the invention was described with reference to a V4-type cylinder block, it will be appreciated that the blocks having more than four cylinders is also contemplated as well as straight cylinder-type engine blocks having more or less cylinders.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described

What is claimed is:

1. A casting core for forming water passages within a cylinder block having a plurality of adjacent cylinders separated from one another by webs of cylinder block material, said casting core comprising;

a continuous water passage-defining endless wall (48) of bonded particulate material for forming a water passage (30) around the periphery of the adjacent cylinders, said wall (48) being void between the cylinders (24); and at least one support element (64) formed of non-decomposable material supported by said wall (48) and covered with a sleeve of woven refractory material (66) and bridging the void between the cylinders formed by the wall (48), wherein said wall portion (48) of said core forms the water passage (30) that encircles the plurality of adjacent cylinders (24) through which water is circulated for cooling the perimeter of the adjacent cylinders (34) and said sleeve-covered support element (64) forms a water passage bypass (32) extending through the webs (26) of cylinder block material between the cylinders (24) and communicating with the encircling water passage (30) for cooling between the adjacent cylinders (24) of the cylinder block (22), said support element having a substantially uniform cross-section to enable said support element to be withdrawn intact from the cylinder block following casting.

2. A casting core as set forth in claim 1 further characterized by said sleeve-covered support element (64) having at least one end (70) that extends beyond and is spaced from said wall (48).

3. A casting core as set forth in claim 2 further characterized by the other end (68) of said sleeve-covered support element (64) terminating within said wall (48).

4. A casting core as set forth in claim 3 further characterized by said sleeve (66) comprising woven glass fibers.

5. A casting core as set forth in claim 4 further characterized by said support element (64) comprising a rectangular metal plate.

6. A casting core as set forth in claim 1 further characterized by said wall (48) including integral water intake (54) and exhaust (56) cores formed of the same bonded particulate material and extending outwardly from said wall (48) for forming water intake (34) and exhaust (36) passages within the cylinder block (22) for circulating the cooling water into and out of the water jacket chamber (28).

7. A casting core as set forth in claim 6 further characterized by said intake (54) and exhaust (56) cores including core prints (58),(60) formed on the ends thereof.

8. A casting core as set forth in claim 7 further characterized by said bonded particulate material comprising sand.

9. A cylinder block assembly of the type having a casting core for defining water passages within the block, said assembly comprising;

a cylinder block (22) defining at least two adjacent piston cylinders (24) arranged in line and separated from one another by a web of cylinder block material (26);

a continuous closed loop wall of bonded particulate material (48) disposed within said cylinder block (22) and completely surrounding said adjacent cylinders (24) but being void between said adjacent cylinders (24) for defining a continuous water passage (30) encircling said adjacent cylinders (24) through which water is circulated for cooling the perimeter of said adjacent cylinders (24); and a support element (64) formed of non-decomposable material covered with a sleeve of woven refractory material (66) and extending through said web (26) for bridging the void formed by said wall (48) and defining a water passage bypass (32) between said adjacent cylinders (24) extending through said web (26) and communicating with said encircling water passage (30) for cooling between said adjacent cylinders (24) of said block (22), said support element having a substantially uniform cross-section for enabling said support element to be withdrawn intact from said bypass passage (32) following casting.

10. An assembly as set forth in claim 9 further characterized by said sleeve-covered support element (64) having at least one end (70) that extends beyond said wall (48) and through said cylinder block (22) such that said end (70) is accessible from the outside of said cylinder block (22) for subsequent removal of the sleeve-covered support element (64) from the cylinder block (22).

11. An assembly as set forth in claim 10 further characterized by an opposite end (68) of said sleeve-covered support element (64) terminating within and supported by said wall (48).

12. An assembly as set forth in claim 11 further characterized by said sleeve (66) comprising woven glass fibers.

13. An assembly as set forth in claim 12 further characterized by said support element comprising a rectangular metal plate.

14. An assembly as set forth in claim 9 further characterized by said wall (48) including integral water intake (54) and exhaust (56) cores formed of a same bonded particulate material and extending outwardly from said wall (48) for forming water intake (34) and exhaust (36) passages within the cylinder block (22) for circulating the cooling water into and out of the water jacket chamber (28).

15. An assembly as set forth in claim 14 further characterized by said intake (54) and exhaust (56) cores including core prints (58), (60) formed on the ends thereof.

16. An assembly as set forth in claim 15 further characterized by said bonded particulate material comprising sand.

17. A method for casting a cylinder block with cored water passageways surrounding at least two adjacent cylinders (24) of a block (22) which are separated from one another by a web of cylinder block material (26), comprising the steps of;

forming a water jacket-forming core of bonded particulate material (48) for forming a water jacket passage (30) around the perimeter of the adjacent cylinders (24);

covering a support element (64) formed of non-decomposable material and of uniform cross-section with a sleeve of woven refractory material (66);

supporting the sleeve-covered support element (64) cross-wise within the water jacket-forming core (48) for forming a water passage bypass (32) extending through the web (26) separating the adjacent cylinders (24);

disposing the water jacket-forming core wall and sleeve-covered support element core assembly (42) within a cylinder block casting mold (62);

casting molten cylinder block metal into the mold (62) and around the core assembly (42) to define the cylinders (24) and water passages (30), (32) and allowing the metal to solidify; and removing the continuous wall portion (48) of the core assembly (42) form within the cast cylinder block (22) to create the water passage (30) that encircles the plurality of cylinders and through which water is circulated for cooling the perimeter of the adjacent cylinders (24) and then withdrawing the support element (64) and sleeve (66) from the cylinder block (22) intact to create the water passage bypass (3) extending between the cylinders (24) and through the web (26) and communicating with the encircling water passage (30) for cooling between the adjacent cylinders (24) of the cylinder block (22).

18. A method as set forth in claim 17 further characterized by axially compressing the sleeve (66) to enlarge its cross-sectional area and perimeter and supporting the sleeve (66) in the enlarged perimeter condition by the support element (64) during casting.

19. A method as set forth in claim 18 further characterized by pulling on the support element (64) to manually withdraw it from the cast cylinder block (22) with the sleeve (66) remaining in the enlarged perimeter condition and attached to the cylinder block (22).

20. A method as set forth in claim 19 further characterized by stretching the sleeve (66) along its length forcing its perimeter to contract and the outer surface of the sleeve (66) to detach from the cylinder block (22) for easy removal.

21. A method as set forth in either of claims 17 or 20 further characterized by forming cylinder liners (38) separate and distinct from the cylinder block (22).

22. A method as set forth in claim 21 further characterized by disposing the cylinder liners (38) within the casting mold (62) and casting the molten cylinder block metal about the cylinder liners (38).

23. A method as set forth in claim 22 further characterized by forming a metallurgical bond (40) between the liners (38) and the cylinder block (22).

24. A method as set forth in claim 23 further characterized by coating the liners (38) with zinc prior to casting and then melting the zinc with the molten cylinder block material during casting and alloying the zinc with the cylinder block and liner metal materials to form the metallurgical bond (40) upon solidification.

* * * * *